United States Patent [19]

Moyer

[11] 4,119,376

[45] Oct. 10, 1978

[54] MOVABLE STORAGE UNIT SYSTEM

[75] Inventor: Ernest P. Moyer, Frederick, Md.

[73] Assignee: American Chain & Cable Company, Inc., Bridgeport, Conn.

[21] Appl. No.: 743,611

[22] Filed: Nov. 22, 1976

[51] Int. Cl.[2] ..... A47B 53/00

[52] U.S. Cl. ..... 312/198; 312/199; 312/200; 214/16 B

[58] Field of Search ..... 312/198, 199, 200, 201; 214/16 B, 16.1 CC

[56] References Cited

U.S. PATENT DOCUMENTS

| | | | |
|---|---|---|---|
| 2,654,489 | 10/1953 | Ingold | 312/199 |
| 2,706,573 | 4/1955 | Ingold | 312/199 |
| 3,152,681 | 10/1964 | Byrnes et al. | 214/16 B |
| 3,168,361 | 2/1965 | Yoshiharunaito | 312/199 |
| 3,615,122 | 10/1971 | Naito et al. | 312/199 |
| 3,777,910 | 12/1973 | Baker et al. | 214/16 B |
| 3,850,105 | 11/1974 | Aronstein et al. | 214/16 B |
| 3,890,903 | 6/1975 | Showell | 312/198 |
| 3,957,322 | 5/1976 | Mastronardi et al. | 312/201 |
| 3,961,831 | 6/1976 | Showell et al. | 312/200 |
| 4,017,131 | 4/1977 | Camenisch | 312/201 |

FOREIGN PATENT DOCUMENTS

| | | | |
|---|---|---|---|
| 1,214,028 | 11/1970 | United Kingdom | 312/201 |

*Primary Examiner*—Mervin Stein
*Assistant Examiner*—Victor N. Sakran
*Attorney, Agent, or Firm*—Barnes, Kisselle, Raisch & Choate

[57] ABSTRACT

A movable storage unit system comprising a plurality of individually driven storage units at least some of which are movable toward and away from one another into contact with one another to define an access space between a pair of the units. A logic control circuit is provided on each unit and a limit sensor is provided on each movable unit including a sensor circuit for creating a signal in response to contact of a pair of storage units. A safety sensor is also provided on each unit and includes a safety sensor control circuit for creating a signal upon engagement of the safety sensor and an object or person in the path of the unit. A pair of reset controls is provided on each unit including a reset control circuit for creating a logic signal when actuated, and a run control is provided on each unit for creating a logic signal when actuated. The storage units are electrically connected such that a logic signal from the run control directs a run signal to a next adjacent unit. Each logic module includes a pair of reset transmit circuits for producing reset output signals, the reset transmit circuits of the logic modules being electrically interconnected. Each logic module includes a command inhibit circuit for receiving a run signal and electrically connected to receive signals from the reset control circuits, safety control circuit, and limit control circuit of its respective storage unit to inhibit the transmittal of the run signal. Each logic module includes a pair of move transmit circuits for producing move signals, the move transmit circuits of adjacent storage units being interconnected. Each logic module includes a move steering logic circuit for producing move command signals, the move command signal actuates a drive unit of a respective storage unit in one direction or the other.

10 Claims, 12 Drawing Figures

FIG. 9
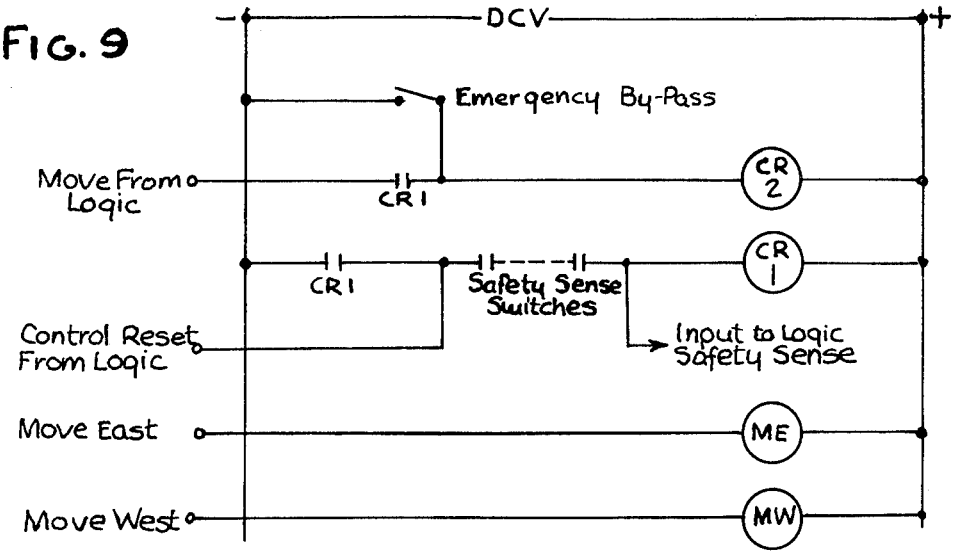
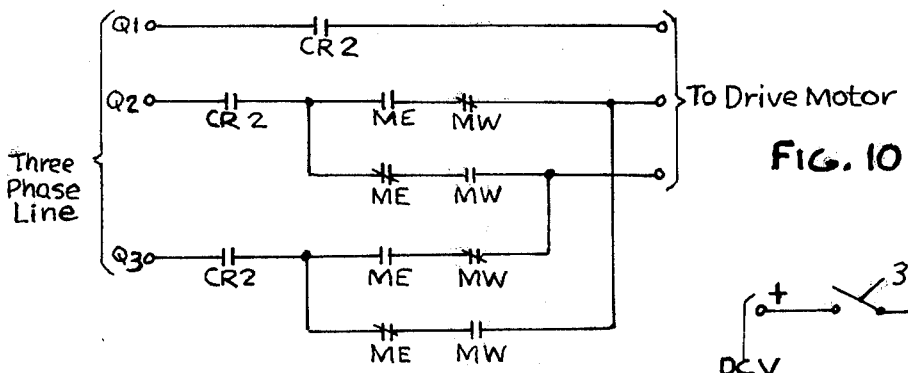
FIG. 10
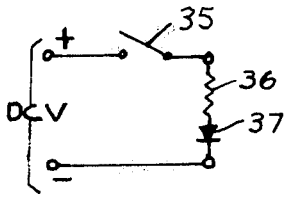
FIG. 11
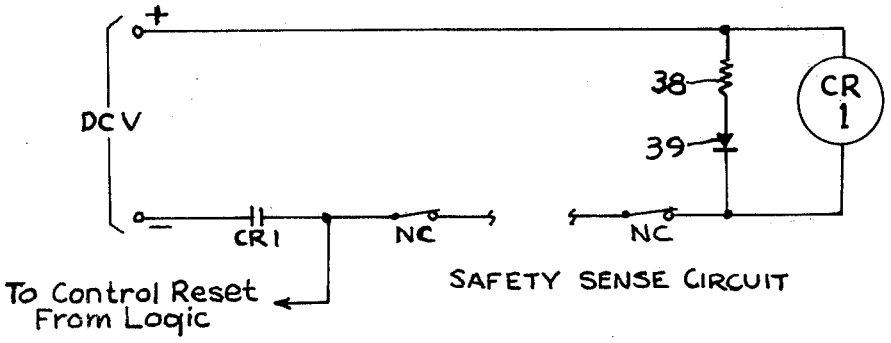
FIG. 12

MOVABLE STORAGE UNIT SYSTEM

This invention relates to a movable storage unit system and particularly to controlling the motion of storage units arranged in contact proximity with one another and selecting a space between any two of the units.

BACKGROUND AND SUMMARY OF THE INVENTION

It is common to provide storage units which are movable by power into contact with one another and can be selectively separated to form an access space. The units may be any device arranged in linear, circular, horizontal, vertical, or any other fashion where sequential order is maintained. The units may be file cabinets, trays, lockers, carriages, platforms, book storage units, freezer lockers, refrigerated units, furniture storage units, tape storage units, or any other device intended for storing, filing, preserving, protecting, accumulating and the like.

The purpose of maintaining contact proximity is to reduce the amount of area, distance, floor space or other volume required for storage. The purpose of selecting a space between any two of the storage units is to gain access to a desired storage location.

While the concept of controlling storage units as described above is not new, and numerous methods have been employed in the past, the present invention is directed to a control system which uses standard control functions in each unit, without the necessity for central control, computing, or monitoring, thus saving in control hardware, and eliminating the need for different assemblies at different locations. The control system can be designed with a standard control device for each of the units, including those which are placed at the end of the sequence. This reduces different replacement control devices to one type with concimitant savings in stock cost and control and simpler maintenance techniques and routines.

In addition, the control system provides for safety controls that require the operator to perform reset functions before operation thereof; wherein once reset, the system must be operated during a predetermined period of time; wherein if operation is discontinued, the operator must perform a reset function; wherein the controls for operation are oriented the same on each storage unit; and wherein there is a redundant safety system deactivating the solid state logic as well as the mechanical relay control.

DESCRIPTION OF THE DRAWINGS

FIG. 9 is a logic signal control chart.

FIG. 10 is an electrical diagram of the drive motor control.

FIG. 11 is a diagram of a limit sensor circuit.

FIG. 12 is a diagram of the electrical sensing circuit.

DESCRIPTION

Figure 1:
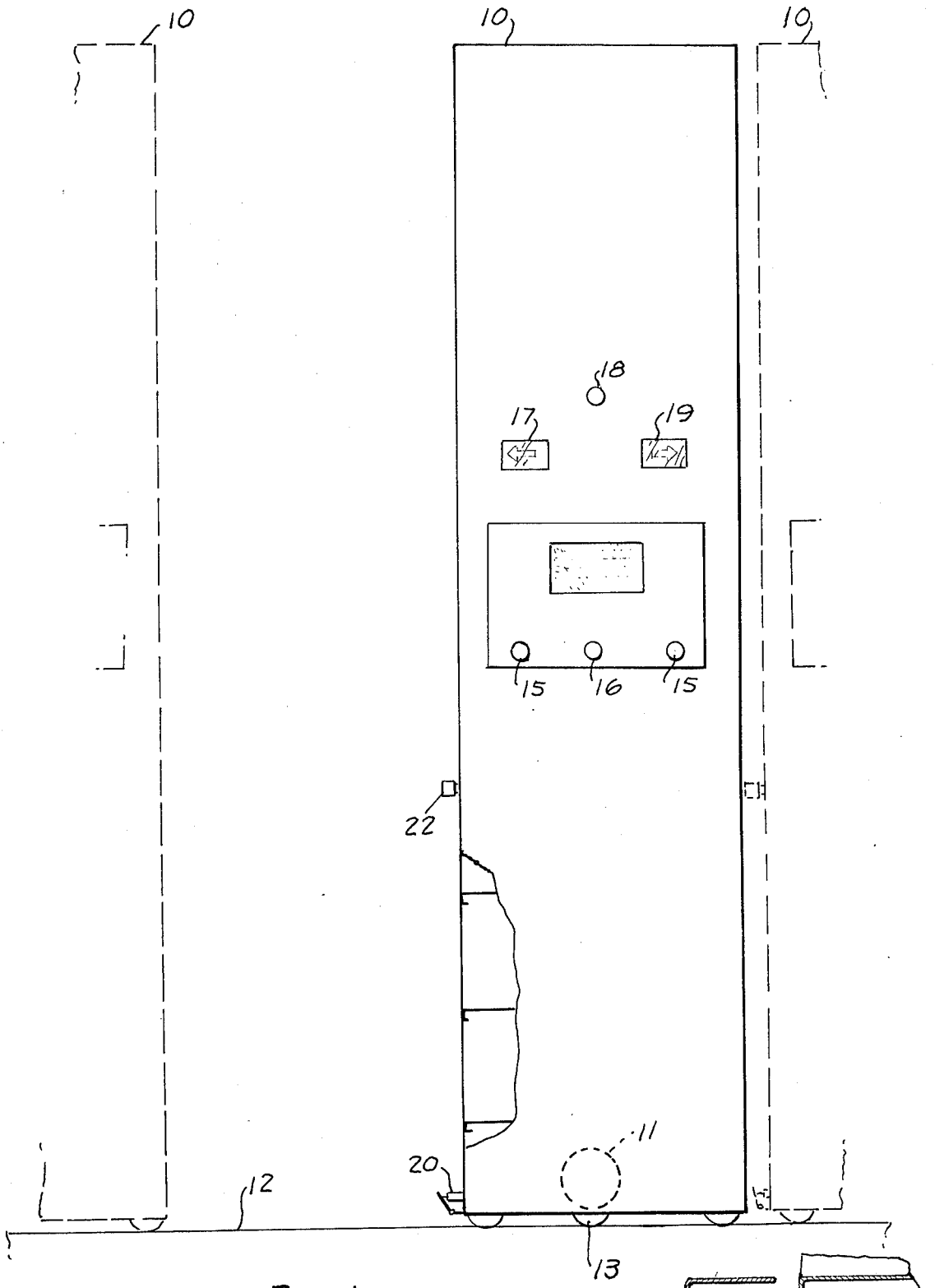
FIG. 1 is a partly diagrammatic side elevational view of a movable storage unit system embodying the invention.
Figure 2:
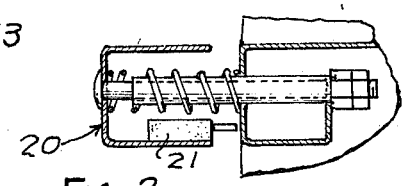
FIG. 2 is a sectional view of a portion of a safety rail shown in FIG. 1.

Referring to FIG. 1, the movable storage unit system embodying the invention is herein shown as applied to book storage units. However, the system is also applicable to any powered storage units arranged in linear, circular, horizontal, vertical, or any other fashion where sequential order is maintained. The units may be file cabinets, trays, lockers, carriages, platforms, book storage units, freezer lockers, refrigerated units, furniture storage units, tape storage units, or any other device intended for storing, filing, preserving, protecting, accumulating, and the like.

As shown, the system includes storage units 10 movable by motors 11 along a track 12. Each motor 11 includes a drive wheel 13 that engages the floor to drive the unit. Such an arrangement is well known as shown, for example, in U.S. Pat. Nos. 3,615,122 and 3,856,446.

Each storage unit 10 includes identical controls and indicators at each end thereof. More specifically, each movable storage unit includes at each end two reset buttons 15 and a run control button 16. Visual signals 17, 18, 19 are also provided at each end. As presently described, in any array of storage units, some of the control buttons are eliminated in the endmost storage units which are stationary.

In addition, each storage unit includes a sensor in the form of a limit bar 20 along each side thereof which operates a limit switch 21 when one storage unit engages another. Furthermore, each storage unit 10 includes a safety sensor in the form of a safety bar 22 extending along each side thereof which is actuated by any object or person in the aisle if a unit 10 is driven toward the object or person. It should be understood that sensors 20, 22 are shown as mechanically operated switches, but other well-known sensors can be used such as optical, acoustical, or magnetic sensors.

Figure 4:
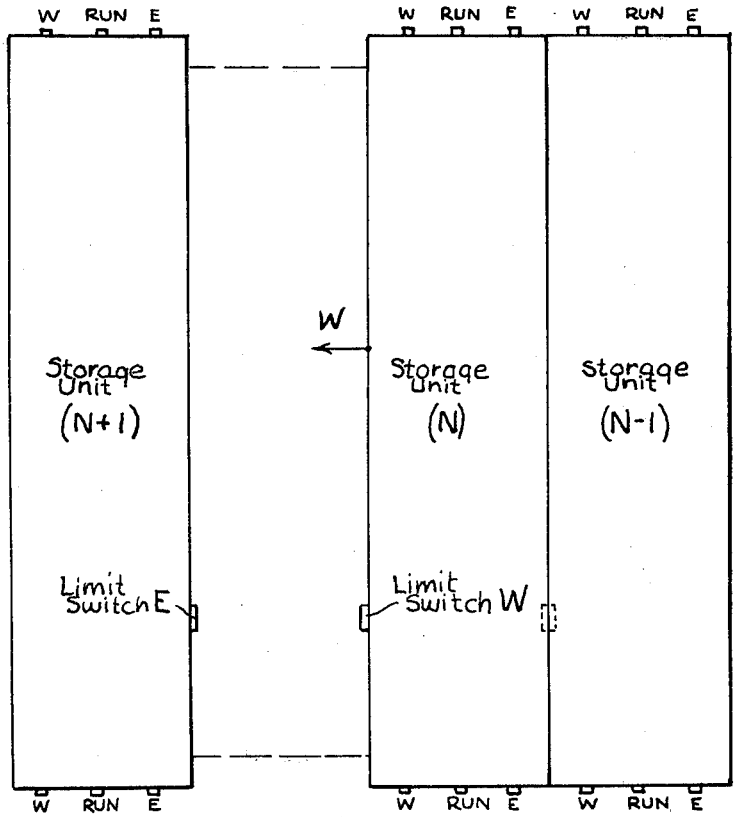
FIG. 4 is a diagrammatic plan view showing another relationship between the units.
Figure 3:
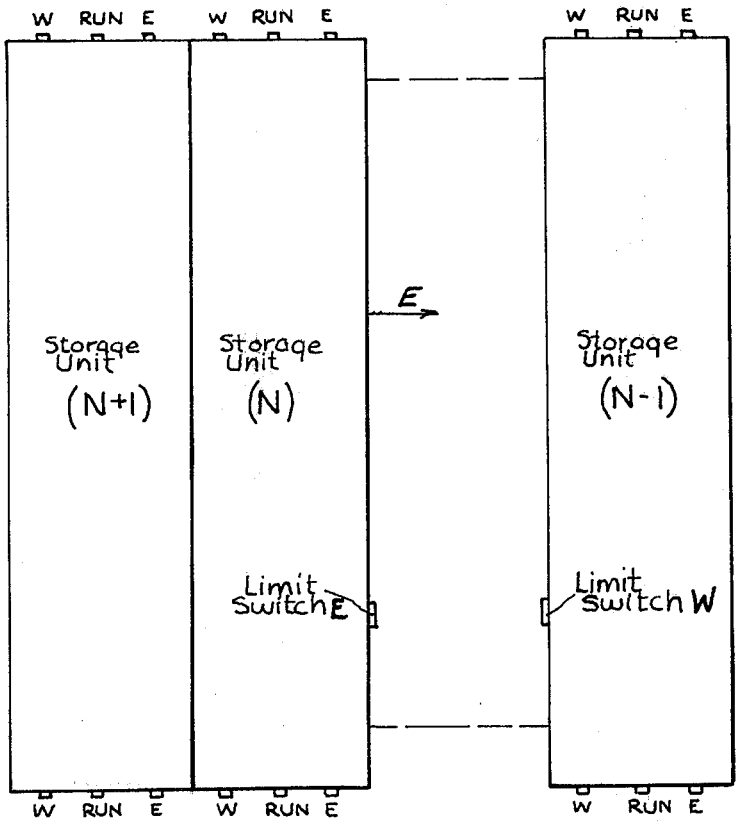
FIG. 3 is a diagrammatic plan view showing one relationship between the units.

The manner in which the control system functions to control and operate the storage units can be understood by reference to FIGS. 3 and 4.

FIG. 3 is a simplified diagram for east motion and FIG. 4 is a diagram for west motion. Any number of additional units may be placed on either or both ends outside of the units shown. The geographical directions are for reference and discussion purposes only.

Assume that east motion is desired (FIG. 3). An operator approaches the storage units from the south. A desired space is shown west of an open space. The number of places the desired space is from the open space can be any value, depending on the installation. The system is designed such that the operator always uses a Run control device to his right, in this case Run (N).

The operator first approaches the open space to observe that it is free of obstructions or personnel. He then causes a reset of the control circuitry by activating reset control devices simultaneously on each side of the open space, Reset W (N−1) and Reset E (N).

Optical indicators 18, 19 show that the system is in either a deactivated or in a run condition. In the deactivated condition, a system reset must be performed. In a run condition, motion must be caused before time out of the system reset circuit.

After activating the system by performing a reset, the operator then moves to the desired space. He activates the Run control to the right of the desired space, Run (N) on unit N. The units to his right then move to the east, filling the open space, until the desired space is available. The motion is stopped by the moving units coming into contact with the stationary units to the east. Sensors exist on both the moving and stationary units to cause motion to cease when the units are on contact with one another, Limit W (N−1) and Limit E (N).

Similar sequence of operations holds for an operator approaching the system from the north. He activates the system by pushing both Reset controls. Reset W (N−1) and Reset E (N). He then moves to the desired space where he depresses the Run button on his right, Run on the (N+1) storage unit. This causes the storage unit or units to move to the east, filling the open space.

Similar action prevails for west motion (FIG. 4). If the safety sensors 22 are activated, all motion stops and is prohibited until the system Reset controls are again activated.

Figure 5:
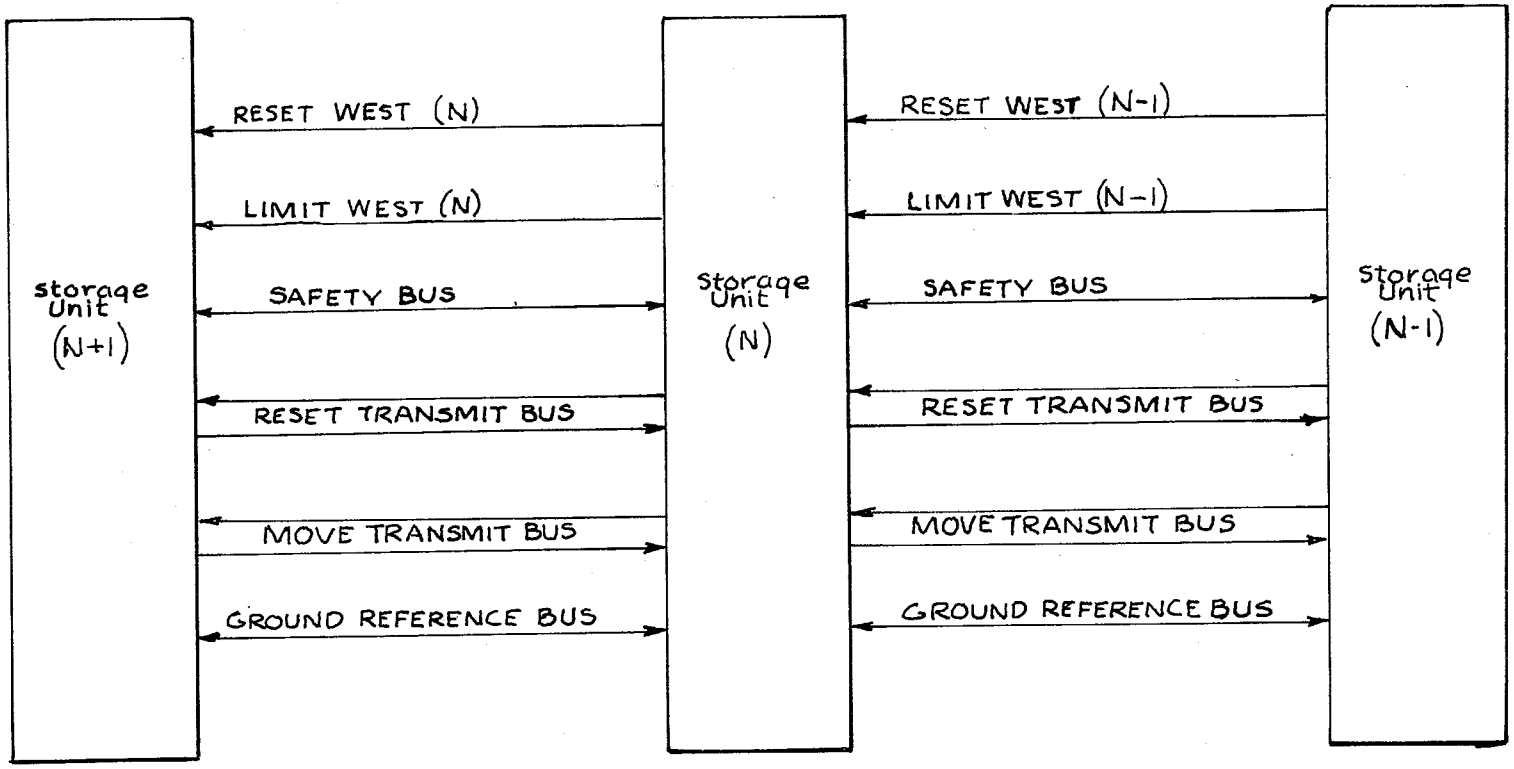
FIG. 5 is a block diagram showing the electrical signal interconnection between storage units.
Figure 6:
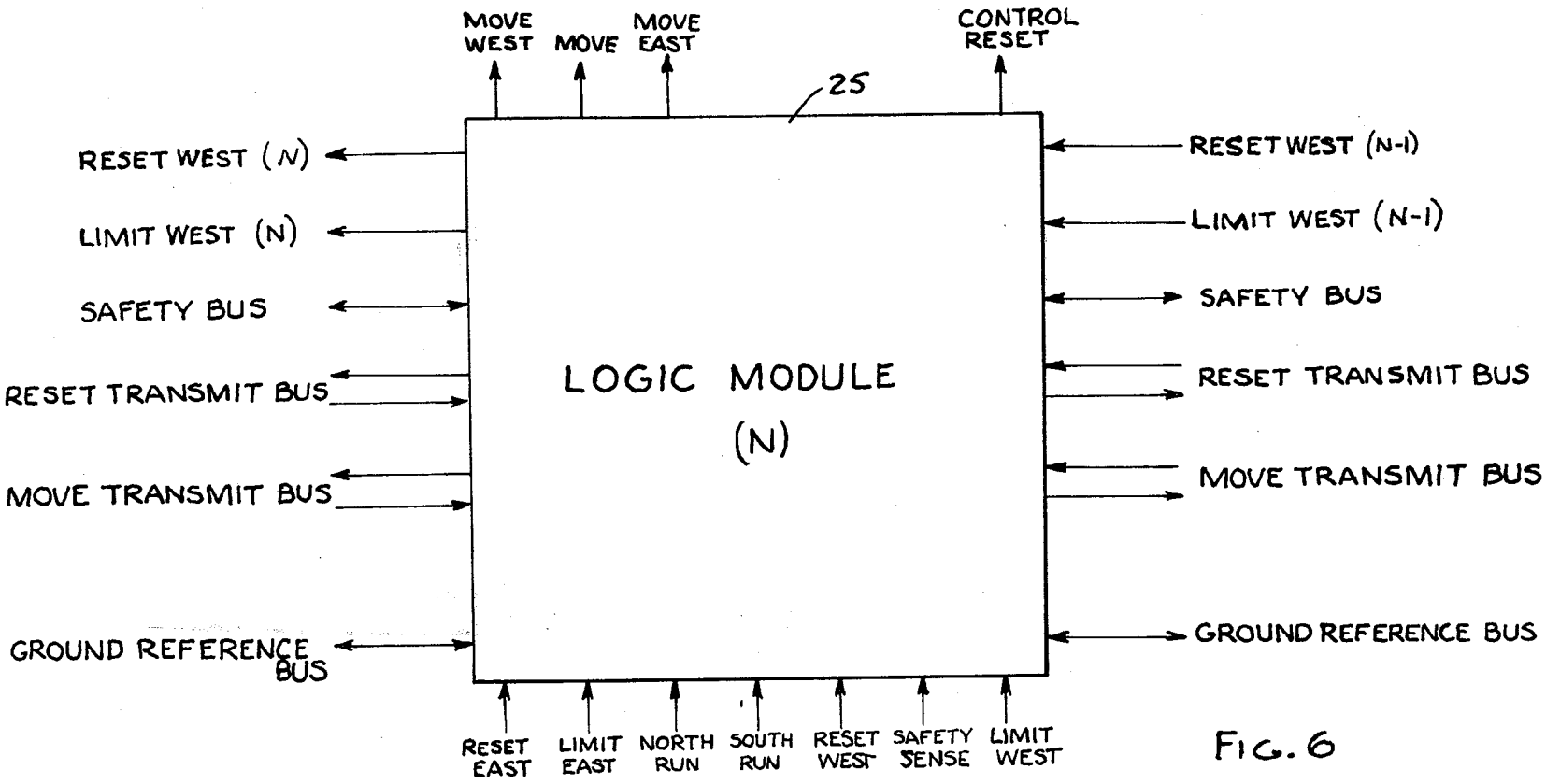
FIG. 6 is a logic module input and output signal chart.

As presently described, each storage unit includes a storage unit logic module 25 having signal lines as indicated in FIG. 6. The logic modules in adjacent storage units 10 are interconnected by signal lines as shown in FIG. 5.

Figure 7:
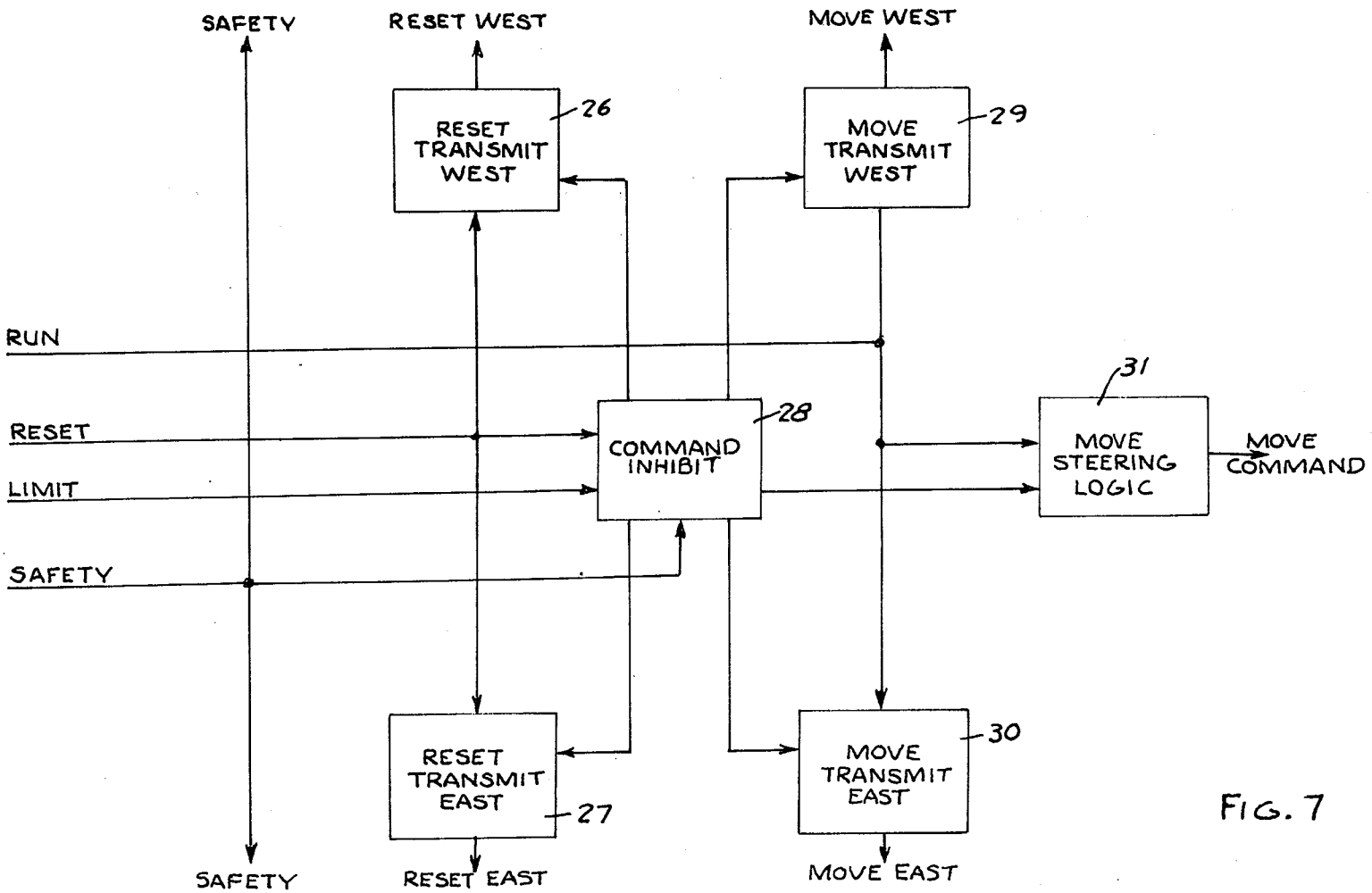
FIG. 7 is a functional block diagram of a logic module.

Each logic module 25 can be represented by the block diagram shown in FIG. 7. When the reset buttons 15 are depressed, a logic signal is provided which sends a signal to the reset transmit modules 26, 27 and, in turn, to adjacent modules 25. In addition, the reset signal passes to a command inhibit module 28. The module 28 functions to inhibit a move signal in the event a safety signal is received from the safety sensor 22 or a limit signal is received from a limit sensor 20. In addition, module 28 functions to inhibit a move signal after a predetermined time delay.

When a run signal is received by activation of run button 16 of the adjacent module 25, a run signal is transmitted through the move modules 29, 30. Each storage unit is successively operated by move steering logic module 31 which transmits a move command signal.

Figure 8:
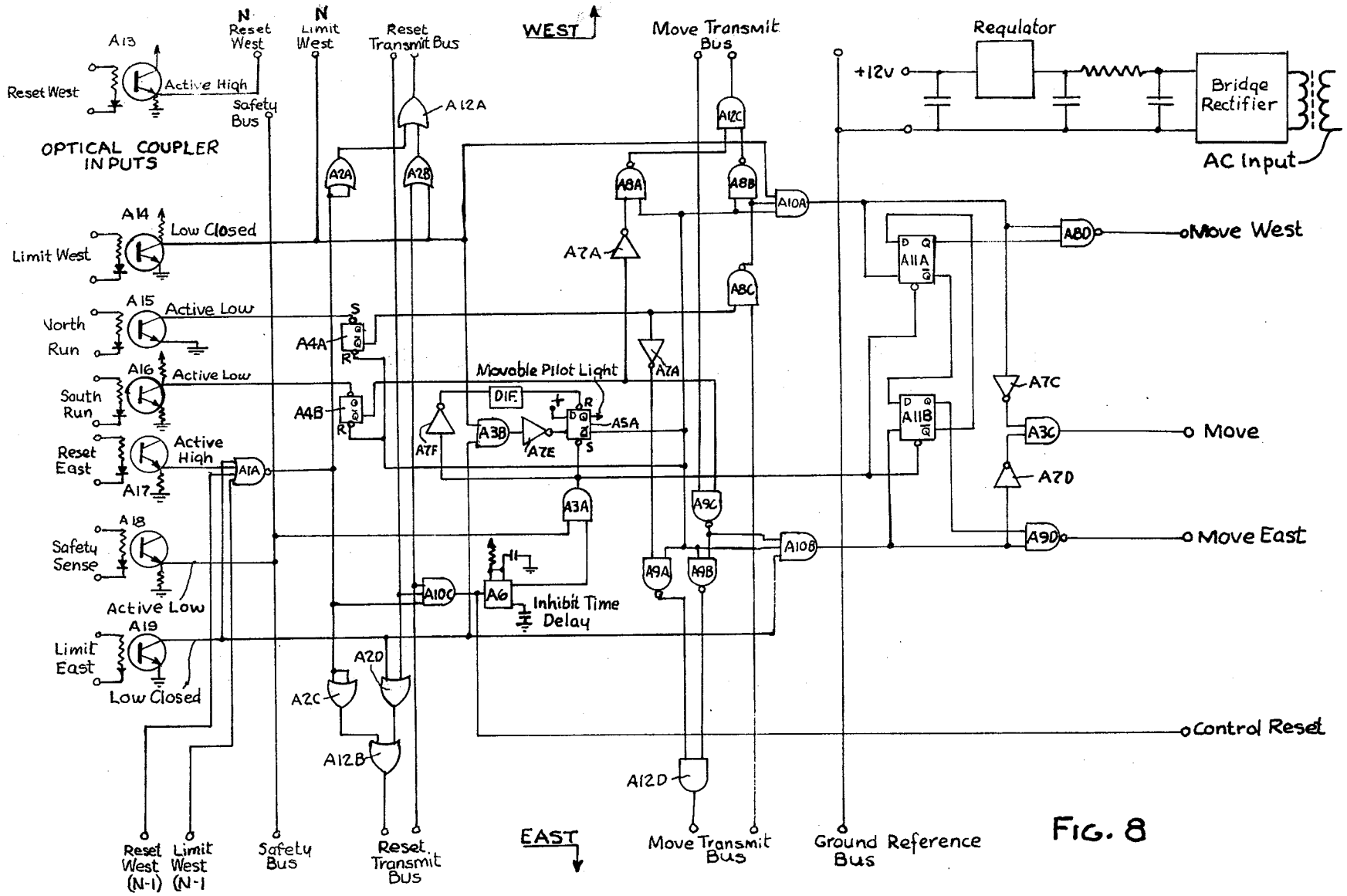
FIG. 8 is a logic circuit diagram of a logic module.

Each module 25 is shown more specifically in FIG. 8 wherein all input signals are active as indicated on the drawing, all output signals are active low, and all bus signals are active low.

Initially, the following conditions exist:

1. Power-up on Inhibit Time Delay A6 produces low output through NAND gate A3A forcing $\overline{Q}$ low on flipflop A5A and Q low on flip-flops A11A and A11B.

2. $\overline{Q}$ low from flip-flop A5A forces high outputs from NAND gates A8A, A8B, A9A and A9B, which produces high outputs through NAND gates A12C and A12D on the Move Transmit Bus.

3. $\overline{Q}$ low from flip-flop A5A produces low inputs through NAND gate A10A and A10B to NAND gates A8D and A9D to force their outputs high. The low levels from AND gates A10A and A10B are inverted by inverters A7C and A7D to produce a high output from AND gate A3C.

4. $\overline{Q}$ low from flip-flop A5A also produces low inputs to logic resets on flip-flops A4A and A4B causing thier $\overline{Q}$ outputs to be high, deactivating move command through A8C and A9C.

5. $\overline{Q}$ high from flip-flops A11B and A11A produces high D input to the opposite half of the flip-flop pair, which are in a cross-coupled arrangement.

6. Q high from flip-flop A5A inhibits activation of the movable pilot light.

Accordingly, since all move outputs are logic high, motion is inhibited.

Assume east motion is desired as shown in FIG. 3. The operator moves to open aisle and pushes Reset buttons, Reset E on storage unit N and Reset W on storage unit N−1. This causes high inputs to NAND gate A1A. NAND gate A1A output will go low only if Limit West (N−1) and Limit East (N) are both high for an open aisle. The purpose of this is to force Reset to an open aisle. Low output from NAND gate A1A produces low through A2A and A2C to make outputs on Reset Transmit Bus low through NAND gates A12A and A12B.

At the same time a low output occurs from AND gates A10C to trigger inhibit time delay A6. Inhibit time delay A6 produces a high output through NAND gate A3A to remove logic set on flip-flop A5A and logic reset on flip-flop A11. However, this occurs only if the safety bus is high, not activated, to gate A3A to an ON condition. The high output from A3A is inverted by inverter A7F through a differentiator to reset flip-flop A5A which produces a high output on $\overline{Q}$ to open the move transmit buses, the move outputs, and to release the run latches A4A and A4B.

The inhibit time delay A6 is used to time-out the control circuitry and force initial conditions a specified period of time after the reset buttons 15 are depressed, adjustable, for example, to 30 seconds or more. This forces an operator to initiate motion during the time-out period, and prohibits another operator from activating the motion controls if the first operator leaves the ranges with incomplete motion status. After the time-out period, the inhibit time delay A6 output will go low, inhibiting all motion.

Reset signals coming into the unit from other units will produce the same action as the local reset button.

To produce motion after depressing the reset buttons at the aisle, the operator moves to the west of the open aisle. In this case, the next immediate aisle is illustrated (FIG. 3). The operator pushes the run button 16 on the right of the desired aisle. A low to "Set" input on run latch A4B causes $\overline{Q}$ output low to gate A9C to force a high on gate A9B. Since the other input to NAND gate A9B is also high, the output goes low. The low is transmitted through A12D onto the move transmit bus. The run latch A4B holds the move command active until reset.

The high from A9C causes a high from A10B which clocks A11B Q output high and gates A9D to cause a low move east signal.

A similar sequence is transmitted through A12C onto the move transmit bus in the opposite direction except that it bypasses gate A8C and is transmitted through gate A8A via inverter A7A. The output of A7D also goes low to cause a low move signal through gate A3C. The high signal through gate A10B is active only if the limit east is high for an open aisle condition. If not, the move east and move signals are blocked. When the unit reaches its limit of motion against the unit next in line the limit east closes, inhibiting motion. At the same time, the low limit east signal produces a high output through gate A3B via inverter A7E to clock flip-flop A5A into a $\overline{Q}$ low output inhibiting the move transmit bus and preventing a move signal from passing through the unit from other units. The $\overline{Q}$ low output from flip-flop A5A also resets the run latch A4B.

If the move command comes from a unit further to the west, move east will be initiated only after limit east goes high when a preceding unit clears the limit sensor 20.

In this manner, motion can take place only in the direction of an open aisle, when the preceding aisle opens, and will cease if the aisle closes.

West motion works in an identical manner (FIG. 3).

North run buttons work in a similar manner, except they are removed by one unit away to achieve control through the run button to the right of the desired aisle.

Operation of the safety bus, either locally or from other units, will always force low signals through gate A3A to set flip-flop A5 and flip-flop A11, inhibiting all motion.

If any aisle is open, transmission of the reset signals through the reset transmit bus is blocked by a high on A2B and A2D. This forces an operator to reset all open aisles individually that may exist due to discontinued motion of a move operation. The run signals bypass through gates A8A and A9A in order to obtain proper direction sensing for run buttons located to the righ of the desired aisle.

When a limit opens, as the preceding unit moves away, it permits run signals to activate the proper move outputs for that unit, even though coming from some other unit down the line.

Run command is sensed on the move transmit bus in both directions, but the sequence of unit motion permits the commands to function only in one direction. A run command will cause motion only for those units between the command source and an open aisle.

If aisles are open to both the east and the west (an unusual condition), and if all resets have been activated properly, all units to the east of the run command will move to the east, and all units to the west of the run command will move to the west. In this manner, motion will always by away from an operator and will create a proper open aisle.

FIG. 9 shows the manner in which the logic and motor controls are interconnected, while FIG. 10 shows the relay circuit for controlling the direction of movement of the motor. The contacts of safety sensor switches 22 are in series with relay CR1. The contacts of relay CR2 are in series with the contacts ME + MW of motor relays ME and MW (controlling east and west operation).

Thus, mechanical interlocks are provided through relay contacts. Safety sense switches must all be closed. Any open safety switch 20 will deactivate power to relay CR1, as well as cause a reset to the logic. Relay CR1 open will open relay CR2 and hence power to the drive motor. Therefore, two events will inhibit motion: Relay CR2 will be open and the move signal from the logic will be inactive.

Relay CR1 has a latch contact which holds it closed after it is set by the control reset from the logic.

The move east and move west relay contacts are arranged in such a manner that if neither are active AC power to the drive motor is off. If both are active, power to the motor is off. Only if either one, but not both, are active will power be applied to the drive motor.

These features are intended to provide redundancy on safety, such that failure in any one component will not activate the drive.

The control logic described above can be mounted in any convenient location on the storage unit. Only one control circuit is required per storage unit, but necessary switches or elements for activating and guiding the storage unit must be located according to the physical arrangement.

Power for the control devices may be derived from the power feed supplying drive motors or other driving devices.

FIG. 11 is a typical optical isolator input circuit associated with limit sensors 20 or reset buttons 15 to produce a signal to the logic and includes a limit sensor 35, a current limiting resistor 36, and an optical coupler diode 37 in series.

FIG. 12 is a typical circuit associated with safety sensors 22 to produce a signal through the optical isolator input to the logic and to deactivate CR1 and comprises a current limiting resistor 38 and an optical coupler diode in parallel with relay CR1.

I claim:

1. In a movable storage unit system, the combination comprising a plurality of storage units at least some of which are movable toward and away from one another into and out of contact with one another to define an access space between a pair of the units, means on each movable unit for driving said unit in two directions, a logic control circuit on each unit, a pair of reset controls on each unit including a reset control circuit for creating a logic signal when actuated, a run control on each unit for creating a logic signal when actuated at a storage unit where an access space is desired, said storage units being electrically connected such that a logic signal from said run control on the storage unit which is to move where an access space is desired directs a run signal to a next adjacent unit to cause said units to be driven successively away from said desired access space, said run signal being inhibited by said reset control circuit unless the reset controls on the storage units on both sides of an open access space are actuated.

2. The combination set forth in claim 1 including time delay means operable to deactivate said logic signal from said reset controls after a predetermined time interval such that said reset controls at said access space must again be actuated.

3. The combination set forth in claim 1 including reset controls and a run control on both ends of each said storage unit such that the movement of the storage units can be initiated from either end.

4. The combination set forth in claim 1 wherein said run control to be actuated for producing motion of the storage units is always in the same orientation to the operator.

5. The combination set forth in claim 1 including means interlocking said control circuits such that run signals can only occur for movement in one direction at any given time and cannot occur for movement in both directions simultaneously.

6. The combination set forth in claim 1 including a safety sensor on each unit including a safety sensor control circuit for creating a signal upon engagement of said safety sensor and an object or person in the path of the unit, said safety sensor control circuit signal being operable to deactivate the logic module and deactivate said driving means.

7. The combination set forth in claim 1 wherein each said logic module includes a pair of reset transmit circuits for producing reset output signals, means electrically interconnecting reset transmit circuits of all said logic modules.

8. The combination set forth in claim 1 including limit sensors on each unit operable to inhibit a run signal to a successive unit until the preceding unit has moved away.

9. The combination set forth in claim 7 wherein each said logic module includes a command inhibit circuit for receiving a run signal and electrically connected to receive signals from said reset control circuits of its respective storage unit to inhibit the transmittal of the run signal, said logic module including a pair of move transmit circuits for producing move signals, means interconnecting the move transmit circuits of adjacent storage units, each said logic module including a move steering logic circuit for producing move command signals, and means responsive to said move command signals for actuating the drive unit of the respective storage unit in one direction or the other.

10. The combination set forth in claim 9 wherein each said command inhibit circuit of each logic module includes a time delay circuit operable to prevent transmittal of a run signal.

* * * * *